US008461947B2

(12) United States Patent
Wendel et al.

(10) Patent No.: US 8,461,947 B2
(45) Date of Patent: Jun. 11, 2013

(54) INSTALLATION SWITCHING DEVICE

(75) Inventors: Joachim Wendel, Sinsheim (DE); Roland Ritz, Dielheim (DE); Joachim Becker, Schwetzingen (DE); Ralf Weber, Heidelberg (DE)

(73) Assignee: ABB AG, Mannheim (DE)

( * ) Notice: Subject to any disclaimer, the term of this patent is extended or adjusted under 35 U.S.C. 154(b) by 0 days.

(21) Appl. No.: 13/353,796

(22) Filed: Jan. 19, 2012

(65) Prior Publication Data

US 2012/0182095 A1 Jul. 19, 2012

(30) Foreign Application Priority Data

Jan. 19, 2011 (DE) ..... 10 2011 008 831

(51) Int. Cl.

| | |
|---|---|
| ***H01H 75/00*** | (2006.01) |
| ***H01H 77/00*** | (2006.01) |
| ***H01H 73/12*** | (2006.01) |
| ***H01H 67/02*** | (2006.01) |

(52) U.S. Cl.
USPC ..... 335/14; 335/6; 335/132; 335/18; 335/16

(58) Field of Classification Search
USPC ..... 335/14, 16, 132, 18, 6
See application file for complete search history.

(56) References Cited

U.S. PATENT DOCUMENTS

| | | | | |
|---|---|---|---|---|
| 4,470,028 | A * | 9/1984 | Vayre et al. | 335/16 |
| 4,688,011 | A * | 8/1987 | Lemmer et al. | 335/159 |
| 4,947,145 | A * | 8/1990 | Ohishi et al. | 335/14 |
| 4,975,665 | A * | 12/1990 | Ohishi et al. | 335/14 |
| 5,184,100 | A * | 2/1993 | Oyama et al. | 335/16 |
| 5,233,321 | A * | 8/1993 | Blanchard et al. | 335/132 |
| 5,276,417 | A * | 1/1994 | Blanchard et al. | 335/132 |
| 5,331,301 | A * | 7/1994 | Glennon et al. | 335/20 |
| 5,339,060 | A * | 8/1994 | Blanchard et al. | 335/132 |
| 5,546,062 | A * | 8/1996 | Duchemin | 335/132 |
| 5,926,081 | A * | 7/1999 | DiMarco et al. | 335/16 |
| 6,150,909 | A * | 11/2000 | Meier | 335/132 |
| 6,949,998 | B2 * | 9/2005 | Lecomte | 335/132 |
| 7,217,895 | B1 * | 5/2007 | Shea et al. | 200/244 |
| 2002/0050878 | A1 * | 5/2002 | Ferree et al. | 335/16 |
| 2010/0019873 | A1 * | 1/2010 | Mueller et al. | 335/6 |

FOREIGN PATENT DOCUMENTS

| | | |
|---|---|---|
| DE | 10 2008 006 863 A1 | 1/2009 |
| WO | WO 2010/130414 A1 | 11/2010 |
| WO | WO 2010/133346 A1 | 11/2010 |

* cited by examiner

*Primary Examiner* — Alexander Talpalatski
(74) *Attorney, Agent, or Firm* — Buchanan Ingersoll & Rooney PC

(57) ABSTRACT

An installation switching device which rapidly disconnects short-circuit currents is provided. A contact lever is arranged at least partially in an air gap in a magnetic circuit such that, in case of a short circuit, the interaction between current flow and magnetic flux within the air gap can result in an electrodynamic force effect, which leads to rapid opening of at least one contact point. A switching mechanism acts via a first operating connecting line on the contact lever to open the contact point and/or to keep it open. In case of overcurrent tripping, an overcurrent release acts, by a switching mechanism and via a second operating connecting line, on the switching mechanism to open the contact point and keep it open. In case of short-circuit tripping, the contact lever acts via a third operating connecting line on the switching mechanism to keep the contact point open.

13 Claims, 3 Drawing Sheets

INSTALLATION SWITCHING DEVICE

RELATED APPLICATION

This application claims priority under 35 U.S.C. §119 to German Patent Application No. 10 2011 008 831.8 filed in Germany on Jan. 19, 2011, the entire content of which is hereby incorporated by reference in its entirety.

FILED

The present disclosure relates to an electrical installation switching device. More particularly, the present disclosure relates to an installation switching device which achieves fast disconnection of a short-circuit current.

BACKGROUND INFORMATION

Installation switching devices may, for example, be circuit breakers, residual current devices, motor protection switches or selective main-line circuit breakers.

One circuit breaker of this type is disclosed, for example, in DE 10 2008 006 863 A1. In a circuit breaker such as this, a short-circuit current is disconnected with the aid of an impact-type armature. The field of a magnet coil through which current flows excites the magnetic circuit within the electromagnetic short-circuit current release, and the impact-type armature is thus moved by electrodynamic interaction. A striking pin is coupled to the impact-type armature and strikes the contact lever, as a result of which the contact point is opened, and the striking pin at the same time acts on the switching mechanism, which leads to unlatching of the switching mechanism and therefore to the contact point being kept open permanently until the switching mechanism is latched again and the contact point can only then be closed again.

In known installation switching devices, overcurrent tripping takes place with the aid of a thermomechanical tripping element, generally a thermal bimetallic strip. The overcurrent heats the thermal bimetallic strip, resulting in its bending. In the bent state, the thermal bimetallic strip unlatches the switching mechanism via an appropriate link by means of a switching mechanism operating element, in response to which the contact point is likewise permanently opened until the switching mechanism is latched again and the contact point can only then be closed again.

In a circuit breaker, the contact lever is generally in the form of a single-armed or two-armed lever which is mounted on a shaft such that it can pivot. The moving contact piece is attached to one of the free ends of the lever. In a motor protection switch, a double contact link is used as a contact lever. The double contact link is mounted such that it can move and is fitted at each of its two free ends with a moving contact piece. The two moving contact pieces interact with a respective stationary contact piece thus forming two contact points and allowing the switching power to be distributed between two contact points, as a result of which each individual contact point is less severely loaded when short-circuit disconnection takes place.

However, in known installation switching devices, the response rate of the magnetic release is limited since it includes a plurality of mechanical subsystems, each of which has a certain amount of mechanical inertia. The current limiting in the event of a short circuit is therefore also limited.

SUMMARY

An exemplary embodiment of the present disclosure provides an electrical installation switching device which includes a housing, and a current path which runs in the housing between a first connecting terminal and a second connecting terminal. The exemplary installation switching device includes at least one contact point including a stationary contact piece and a moving contact piece, where the at least one contact point is configured to at least one of open and close the current path. The exemplary installation switching device also includes a contact lever through which at least part of the current in the current path flows and which is provided with the moving contact piece of the at least one contact point. In addition, the exemplary installation switching device includes an electromagnetic short-circuit current release including a magnetic circuit with an air gap. Furthermore, the exemplary installation switching device includes an overcurrent release having a switching mechanism operating element which is configured to change from a rest position to a trip position in the event of overcurrent tripping. The exemplary installation switching device also includes a switching mechanism including a striking lever which is configured to be pivoted between a rest position and a trip position. The contact lever is arranged at least partially in the air gap in the magnetic circuit to cause, in the event of a short circuit, an electrodynamic force effect based on an interaction between flow of the current and a magnetic flux within the air gap, where the electrodynamic force effect causes rapid opening of the at least one contact point, on the contact lever. The switching mechanism is configured to act, via a first operating connecting line, on the contact lever to at least one of open the at least one contact point and keep the at least one contact point open. In the event of overcurrent tripping, the overcurrent release is configured to act, by means of the switching mechanism and via a second operating connecting line, on the switching mechanism to open the at least one contact point and keep the at least one contact point open. In the event of short-circuit tripping, the contact lever is configured to act, via a third operating connecting line, on the switching mechanism to keep the at least one contact point open.

BRIEF DESCRIPTION OF THE DRAWINGS

Additional refinements, advantages and features of the present disclosure are described in more detail below with reference to exemplary embodiments illustrated in the drawings, in which.

Figure 1:
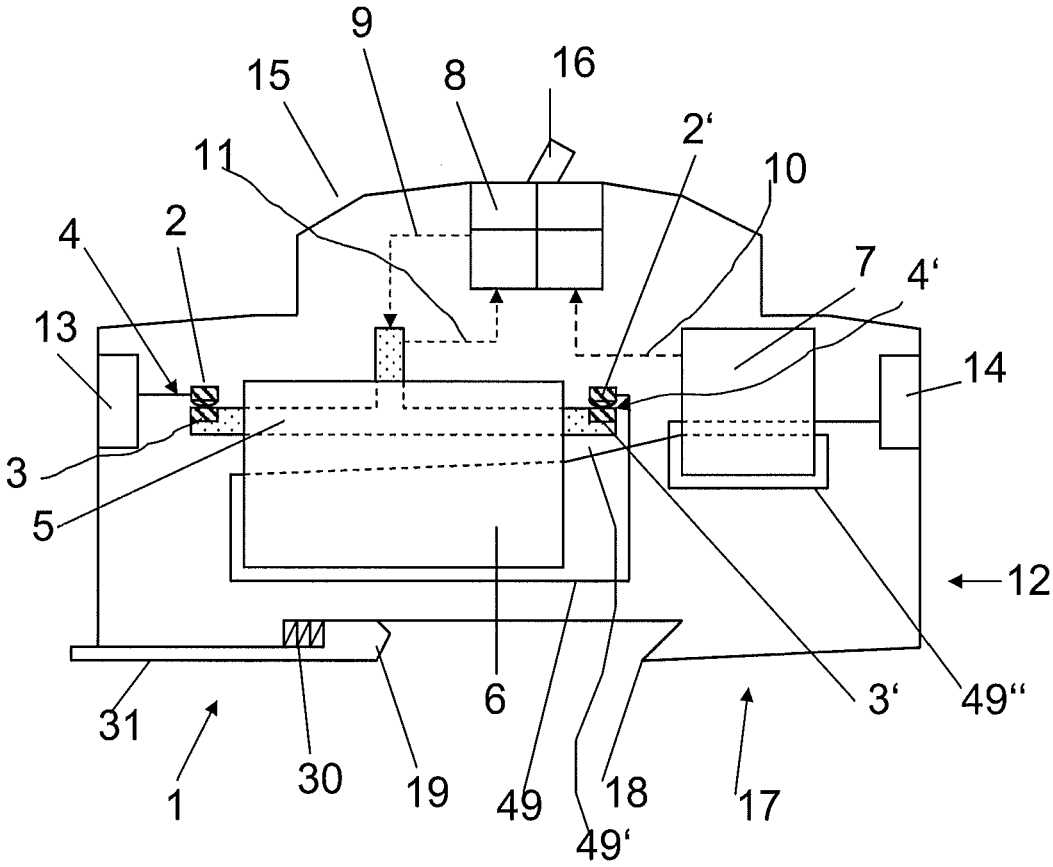
FIG. 1 shows a schematic view of an installation switching device according to exemplary embodiment of the present disclosure.

In the description of exemplary embodiments below, various directions are described to illustrate features of the present disclosure with reference to the orientation of the constituent elements illustrated in the drawings. It is to be understood that the directions used in the following description are exemplary, and the present disclosure is not limited thereto.

DETAILED DESCRIPTION

Exemplary embodiments of the present disclosure provide an installation switching device which achieves a faster short-circuit current disconnection than can be achieved with known techniques.

An exemplary embodiment of the present disclosure provides an electrical installation switching device including a current path which runs in a housing between a first connecting terminal and a second connecting terminal and which can be opened and closed at least one contact point which includes a stationary contact piece and a moving contact piece. The exemplary electrical installation switching device also includes a contact lever through which at least part of the current in the current path flows and which is provided with the at least one moving contact piece. In addition, the exemplary electrical installation switching device includes an electromagnetic short-circuit current release having a magnetic circuit with an air gap. The exemplary electrical installation switching device also includes an overcurrent release having a switching mechanism operating element which changes from a rest position to a trip position in the event of overcurrent tripping. Furthermore, the exemplary electrical installation switching device includes a switching mechanism having a striking lever which can be pivoted between a rest position and a trip position.

In accordance with an exemplary embodiment of the present disclosure, the contact lever is arranged at least partially in the air gap in the magnetic circuit such that, in the event of a short circuit, the interaction between the current flow and the magnetic flux within the air gap can result in an electrodynamic force effect, which leads to rapid opening of the at least one contact point, on the contact lever. The switching mechanism acts via a first operating connecting line on the contact lever in order to open the contact point and/or to keep it open. In the event of overcurrent tripping, the overcurrent release acts, by means of the switching mechanism and via a second operating connecting line, on the switching mechanism in order to open the contact point and keep it open. In the event of short-circuit tripping, the contact lever acts via a third operating connecting line on the switching mechanism in order to keep the contact point open.

An installation switching device according to the present disclosure has the advantage that short-circuit currents are disconnected more quickly than in a known device. In the event of overcurrent tripping, the contact point is kept open permanently after unlatching of the switching mechanism, where reconnection after renewed latching of the switching mechanism, etc., is still available, in the normal manner.

In accordance with an exemplary embodiment, the magnetic short-circuit current tripping included in the installation switching device according to the present disclosure advantageously provides that a direct interaction can take place between the magnetic flux or field of the magnetic circuit and the contact lever. This allows the contact point to be opened much more quickly than in impact-type armature systems as used in known circuit breakers, in which, as already mentioned, the mechanical inertia of the moving components involved limits the tripping rate. In the magnetic field-circuit current tripping included in the installation switching device according to the present disclosure, a force acts on the contact lever, which force results from the force effect, which is known as the Lorentz force, of a magnetic field on an electrical charge which is moving in the field. This force effect takes place directly, without the interposition of mechanical components such as a moving armature or striking pin. According to an exemplary embodiment, in order to ensure that the contact point is kept open permanently, the contact lever itself acts on the switching mechanism in order to keep it open. According to an exemplary embodiment of the present disclosure, the contact lever therefore carries out an additional function of unlatching the switching mechanism, in addition to that of supporting the moving contact. When overcurrent tripping takes place, the contact point is opened and kept open, as is known, via the switching mechanism.

According to an exemplary embodiment of the present disclosure, the contact lever can be in the form of a moving contact link which is provided with two moving contact pieces which interact with two stationary contact pieces in order to form two contact points. This results in a double contact point, which has the advantage that each individual partial contact point is more lightly loaded than in the case of a single contact point when short-circuit current disconnection takes place.

According to an exemplary embodiment of the present disclosure, the switching mechanism operating element of the overcurrent release is coupled to an overcurrent magnetic circuit. The force which acts on the switching mechanism operating element is produced by the magnetic field of the overcurrent. The switching mechanism operating element is coupled to an electromagnetic damping element in order to set the tripping delay time. The switching mechanism operating element is coupled to an adjusting element in order to adjust the overcurrent tripping threshold. In this exemplary embodiment, the overcurrent tripping can also be in the form of a magnetic tripping system. This has the advantage that the overcurrent tripping can take place independently of temperature. This is because, in the case of known thermal bimetallic strip releases, the bimetallic strip is also deformed when the ambient temperature changes, for which reason an overcurrent release such as this is often coupled to a compensation apparatus. On the contrary, the magnetic overcurrent release used in the installation switching device according to the present disclosure is not dependent on temperature.

According to an exemplary embodiment of the present disclosure, the switching mechanism operating element can be a shaft which is mounted such that it can rotate about its longitudinal axis. This can be achieved, for example, by coupling the switching mechanism operating element to a rotor which is approximately cylindrical in shape. The switching mechanism operating element includes a permanent magnet and is mounted such that it can rotate in the internal area of a stator which is approximately tubular, where the stator is part of the magnet core of the magnetic circuit, and at least one turn of the conductor which carries the current of the current path surrounds the stator. In the event of an overcurrent, the magnetic field of the magnetic circuit, induced by the overcurrent in the conductor, causes the rotation of the rotor, and therefore of the switching mechanism operating element. The rest position and the trip position of the switching mechanism operating element can thus be fixed by different angular positions of the rotor with respect to the stator.

According to an exemplary embodiment of the present disclosure, the switching mechanism operating element can be provided at its free end with a control cam body which has a control cam, and the striking lever can be supported on the control cam when the switching mechanism operating element moves to the trip position, that is to say when the rotor is rotated, thus pivoting the striking lever to the unlatching position. The second operating connecting line between the overcurrent release and the switching mechanism runs via the shaft of the rotor, the control cam of the control cam body, to the striking lever.

According to an exemplary embodiment of the present disclosure, the control cam can be in the form of a ramp having a first cam section and a second cam section, with the ramp gradient being flatter in the first cam section than in the second cam section. This arrangement prevents excessively fast tripping and results in tolerance compensation for the position of the axis of the shaft with the ramp. The higher gradient towards the end of the rotary movement advantageously results in reliable tripping.

With respect to the arrangement of the functional assemblies in the interior of the housing of an installation switching device according to the present disclosure, an exemplary embodiment provides that the short-circuit current release and the overcurrent release are arranged one behind the other in the housing, as seen in the flow direction of the current through the current path. This allows for particularly good space utilization.

According to an exemplary embodiment of the present disclosure, the housing can be approximately in the form of an inverted T, having a front face, and is provided on the front face with an operating lever for manual operation of the switching mechanism. The switching mechanism is arranged in the housing, between the short-circuit current release and the front face. In accordance with an exemplary embodiment, the switching mechanism is arranged in the area of the long limb of the T-shape of the housing, and the overcurrent release and the short-circuit release are arranged in the area of the lateral limb of the T-shape of the housing.

According to an exemplary embodiment of the present disclosure, the housing has an attachment face which is opposite the front face and is provided with attachment means for latching the housing onto a standard profile mounting rail. In accordance with an exemplary embodiment, an attachment means such as this can be an approximately U-shaped cutout which is bounded by a stationary tab and a moving tab, which is fitted to a slide which is mounted such that it can move and is acted on in a sprung manner in the direction of the stationary tab.

Further advantageous refinements and improvements of the present disclosure are described below with reference to the drawings.

FIG. 1 shows a schematic view of an installation switching device 1 according to an exemplary embodiment of the present disclosure. In the example of FIG. 1, the installation switching device 1 is illustrated as a circuit breaker. The installation switching device 1 includes a housing 12 which has a front face 15 and an attachment face 17. On the attachment face 17, the housing 12 has a U-shaped cutout, which is bounded by a stationary tab 18 and a moving tab 19, which is fitted to a slide 31. The slide 31 is mounted such that it can move and is acted on by means of a spring 30 in a sprung manner in the direction of the stationary tab 18, in order to latch the housing 12 to a standard profile mounting rail, in a known manner.

A current path runs, inter alia, via conductor pieces 49, 49', 49" and through the housing 12, between a first connecting terminal 13 on a first narrow face of the housing 12 and a second connecting terminal 14 on an opposite second narrow face of the housing 12. This current path can be opened and closed at a double contact point 4, 4'. For this purpose, a contact lever 5 is located in the current path. The contact lever 5 is in the form of a moving contact link and is provided with two moving contact pieces 3, 3' which interact with two stationary contact pieces 2, 2' in order to form the double contact point 4, 4'.

The contact lever 5 is integrated in a magnetic short-circuit release 6, which includes a magnetic circuit with an air gap. A magnetic short-circuit release such as this is known, for example, from WO 2010/130414 A1. In this case, the contact lever 5 is arranged at least partially in the air gap in the magnetic circuit, as a result of which an electrodynamic force can act on the contact lever 5 in the event of a short circuit, because of the interaction of the current flow with the magnetic flux within the air gap, accelerating the contact lever 5 very quickly in the direction of the attachment face 17, and thus tearing the moving contact pieces 3, 3' away from the stationary contact pieces 2, 2', and therefore opening the double contact point 4, 4' very quickly. In this case, the contact points 4, 4' can be opened in a time of less than one millisecond, which is faster than could be achieved with known electromagnetic impact-type armature systems.

In conjunction with the magnetic short-circuit current release 6, the current path runs through an overcurrent release 7, and from there to the connecting terminal 14. The overcurrent release 7 is a magnetically acting overcurrent release whose basic design and whose method of operation and principle of operation are described in WO 2010/133346 A1.

As can be seen, the housing 12 is approximately in the form of an inverted T. The current path with the magnetic release 6 and the overcurrent release 7 runs essentially in the laterally running limb of the T-shape. A mechanical switching mechanism 8 is located in the vertical limb of the T-shape. In accordance with an exemplary embodiment, the mechanical switching mechanism 8 is provided with an operating lever 16 and can be operated by the operating lever 16. The operating lever 16 is mounted in a shaft 32 which is fixed to the housing 12 and projects from the front face 15, such that it can be operated from outside the housing 12. The switching mechanism 8 is designed based on the switching mechanism described in DE 10 2008 006 863 A1, as can also be seen in FIG. 2, and in particular in FIG. 3. The switching mechanism 8 includes a tripping lever 20 and a latching lever 23, which together form a latching point. The latching lever 23 has an elongated hole 24 in which a bracket 25 is guided, whose other end is coupled to the operating lever 16, in this case also annotated in FIG. 2 as a switching handle 22. Furthermore, the switching mechanism 8 includes an intermediate lever 26, one of whose ends is pivotably coupled to the bracket 25, and whose opposite other end is pivotably coupled to a first end of a locking lever 27. The locking lever 27 is borne such that it can pivot in a shaft 33 which is fixed to the housing 12. A switching mechanism spring 34, which is in the form of a spring clip and one of whose limbs 35 is supported fixed to the housing 12, acts on the locking lever 27 with a force which tries to rotate it in the clockwise direction about the shaft 33. The other end 44 of the locking lever 27 is fitted with an attachment part 45, which is integrally formed approximately at right angles, and is fitted with a plastic cover 46.

Furthermore, the switching mechanism 8 includes a striking lever 21 which is in the form of a double-armed lever and is borne such that it can pivot about a shaft 36 which is fixed to the housing 12, and whose first arm 37 acts on the tripping lever 20 on pivoting in the clockwise direction, pushing the latter away in the anticlockwise direction, as a result of which the latching point is then unlatched.

Figure 2:
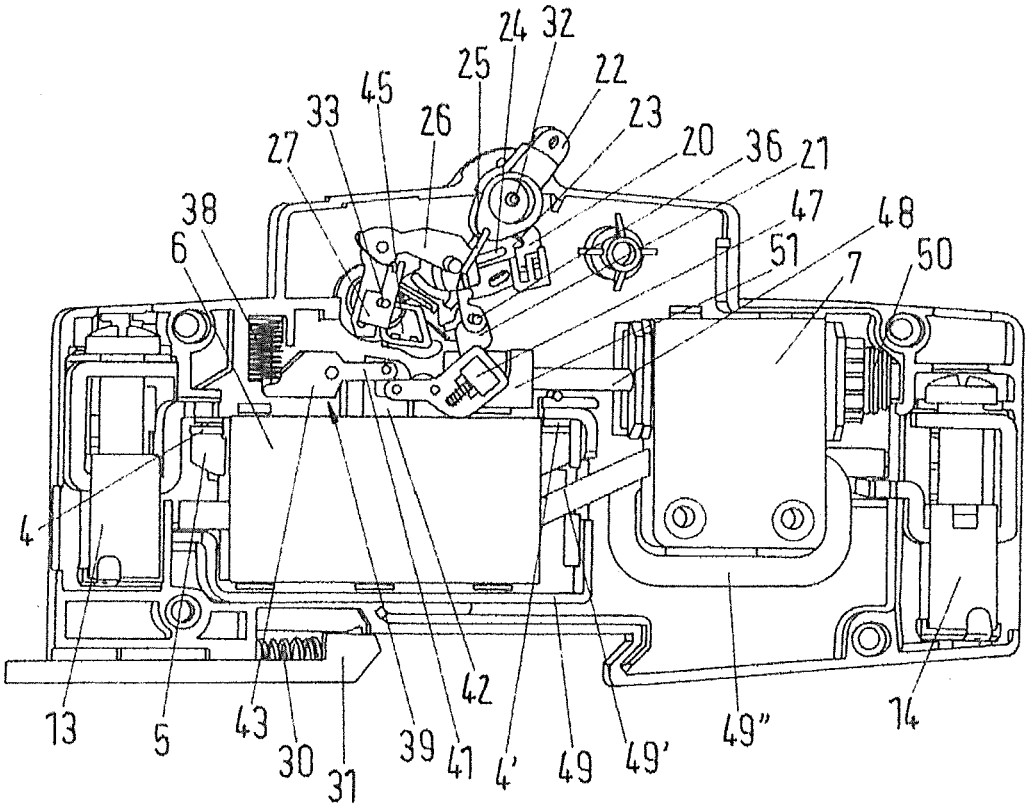
FIG. 2 shows a view into the open housing lower part of an installation switching device according to an exemplary embodiment of the present disclosure.
Figure 3:
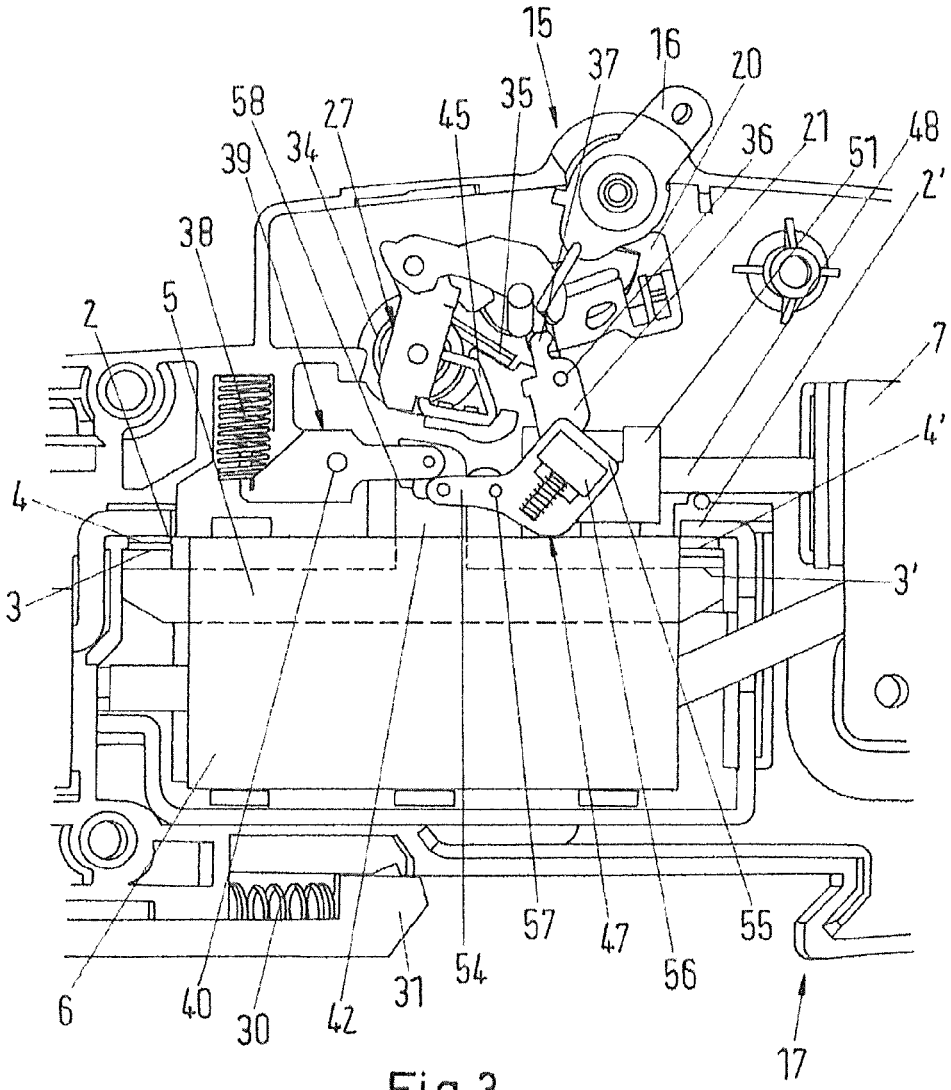
FIG. 3 shows an enlarged partial view of the coupling point between the switching mechanism operating element and the striking lever, corresponding to the view shown in FIG. 2.

In the connected state, the contact lever 5 is pushed upwards in the direction of the front face by means of a contact compression spring 38, as shown in FIG. 2, thus closing the double contact point 4, 4' and allowing current to flow. A transmission lever 39 is provided for this purpose, which is in the form of a double-armed lever and is borne such that it can pivot about a shaft 40 which is fixed to the housing. A first limb 41 of the transmission lever 39 is coupled to an attachment arm 42 of the contact lever 5, which projects upwards out of the short-circuit current release 6. The second limb 43 of the transmission lever 39 is acted on by the contact compression spring 38, for example, a cylindrical spring which is supported at its other end fixed to the housing, to be precise in the anticlockwise direction. In the connected state, as is illustrated in FIGS. 1 to 3, the contact compression spring 38 therefore attempts to pull the contact lever 5 upwards via the transmission lever 39, and thus attempts to keep the contact points 4, 4' closed.

In the connected state, the latching point between the tripping lever 20 and the latching lever 23 is latched, and the switching handle 22 is in the position pivoted to the right in the illustrated exemplary embodiment. The locking lever 27 is now pivoted in the anticlockwise direction via the lever chain formed by the switching handle 22, the bracket 25 and the intermediate lever 26, until the plastic cover 46 on the attachment part 45 thereof is sufficiently far away from the attachment 42 on the contact lever 5, as a result of which the contact lever 5 can be pulled upwards by the transmission lever 39, under the influence of the contact compression spring 38, in order to close the contact points 4, 4'.

For manual disconnection, the switching handle 22 is pivoted to the left, that is to say in the anticlockwise direction, to the disconnected position from its connected position, as shown in the example of FIG. 1. In this case, in the interior of the switching mechanism 8, the latching point between the tripping lever 20 and the latching lever 23 is unlatched by pivoting the tripping lever 39 to the right under the influence of the switching handle 22. This results in the rigid lever chain collapsing, as a result of which the intermediate lever 26 becomes free and can slide to the right. The resetting force of the switching mechanism spring 34 can now pivot the locking lever in the clockwise direction such that, with the plastic cover 46 on its attachment part 45, it pushes the contact link 5 downwards to its open position, against the resetting force of the contact compression spring 34. The latching point is then latched again, and the switching mechanism is ready for reconnection.

For manual connection when the latching point is latched, the switching handle 22 is pivoted back to its connected position. In the process, the pivoting movement of the operating lever 22 is converted via the lever chain—which is rigid again in the latched state—to a pushing movement to the left, which acts on the locking lever 27 and pivots this against the resetting force of the switching mechanism spring 34, such that the plastic cover 46 on the attachment part 45 thereof releases the contact link 5. This is thus pushed upwards to its rest position again by the transmission lever 39, under the influence of the contact compression spring 38. The double contact point 4, 4' is closed again.

In FIG. 1, the operative connection just described between the switching mechanism 8 and the contact lever 5 is indicated by the first operating connecting line 9.

In the event of short-circuit current tripping, the contact lever 5 is pulled very quickly downwards into the short-circuit current release 6, with a force which is greater than the resetting spring force of the contact compression spring 38. The attachment 42 on the contact lever 5 is coupled via a deflection lever 47 (see FIG. 2) to the striking lever 21, to be precise such that the deflection lever pivots the striking lever in the clockwise direction when the contact lever 5 is pulled downwards into the core of the short-circuit current release 6. The pivoting of the striking lever in the clockwise direction results in its force acting on the tripping lever and pivoting on the tripping lever, as a result of which the latching point of the switching mechanism 8 is unlatched. As described above, this results in the contact lever 5 being held in the open position by the locking lever 27. The contact point 4, 4' will have been opened very quickly by the short-circuit current release 6, with the switching mechanism being unlatched and resulting in the contact point 4, 4' being kept open permanently until manual reconnection takes place.

The overcurrent release 7 is a magnetically acting overcurrent release, as described in WO 2010/133346 A1. A switching mechanism operating element is formed on it, in the form of a shaft 48 which is mounted such that it can rotate about its longitudinal axis. Furthermore, the overcurrent release 7 has a setting element 50 in the form of a restraint spring. When an overcurrent occurs, the magnetic circuit of the overcurrent release 7 exerts a torque on the shaft 48 and attempts to rotate it in the clockwise direction. This occurs only when the drive torque acting on the shaft 48 exceeds the restraint torque exerted on the shaft 48 by the restraint spring. The response threshold of the overcurrent release 7 is therefore adjustable.

A control cam body 51 is formed at the free end of the shaft 48 and is approximately in the form of a cylinder which is cut open in places at the side. A control cam 52 is formed in the cut-open part in the control cam body 51. The second arm 53 of the striking lever 21 is supported on the control cam 52. The control cam 52 is in the form of a three-dimensional surface, as a result of which it runs in the form of a ramp on the second arm 53 of the striking lever 21 when the shaft 48 is moved to the trip position, that is to say when the shaft 48 is rotated in the clockwise direction. Because of the ramp gradient, the striking lever 21 is pivoted in the clockwise direction during rotation of the shaft 48, as a result of which its first arm can act on the tripping lever 20 in order to unlatch the switching mechanism, and in order to open the contact point 4, 4'.

The control cam 52 is in the form of a ramp having a first cam section and a second cam section, with the ramp gradient being flatter in the first cam section than in the second cam section. This presents excessively fast tripping and provides tolerance compensation for the position of the axis of the shaft 48 with the ramp on the control cam 52. The greater gradient towards the end of the rotary movement of the shaft 48 advantageously results in reliable unlatching of the latching point, and therefore in reliable tripping.

Therefore, in the event of an overcurrent, the contact point 4, 4' will have been opened by the overcurrent release 7, by the rotational movement of the shaft 48 of the overcurrent release 7 being converted by means of the control cam 52 to a pivoting movement of the striking lever 21, as a result of which the switching mechanism is unlatched, and the contact point 4, 4' is held open permanently until manual reconnection takes place.

The installation switching device described above can be used particularly advantageously for protection of circuits with a low rated voltage, for example of 60 V, AC or DC, because no arc quenching device is required as a short-circuit current is disconnected very quickly by the electrodynamic short-circuit current release 6; since the anode-cathode voltage is already sufficiently great that it exceeds the 60 V rated voltage, as a result of which the current is thus interrupted; no additional arc voltage is required in order to counteract the voltage present at the terminals, for disconnection. The installation switching device described above can likewise be used advantageously for applications where the ambient temperature fluctuates widely, because there is no need for temperature compensation for the overcurrent release, since the overcurrent release operates on a magnetic principle.

The present disclosure also covers any other further desired combinations of exemplary embodiments as well as individual refinement features or developments, provided that these are not mutually exclusive.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

1 Electrical installation switching device
2, 2' Stationary contact piece
3, 3' Moving contact piece
4, 4' Contact point
5 Contact lever
6 Short-circuit current release
7 Overcurrent release
8 Switching mechanism
9 First operating connecting line
10 Second operating connecting line
11 Third operating connecting line
12 Housing
13 Connecting terminal
14 Connecting terminal
15 Front face
16 Operating lever
17 Attachment face
18 Attachment means, fixed tab
19 Attachment means, moving tab
20 Tripping lever
21 Striking lever
22 Switching handle
23 Latching lever
24 Elongated hole in the latching lever
25 Bracket
26 Intermediate lever
27 Locking lever
30 Spring
31 Slide
32 Shaft fixed to the housing
33 Shaft fixed to the housing
34 Switching mechanism spring
35 Limb of the spring clip
36 Shaft fixed to the housing
37 First arm
38 Contact compression spring
39 Transmission lever
40 Shaft fixed to the housing
41 First limb of the transmission lever
42 Attachment
43 Second limb of the transmission lever
44 Other end of the locking lever
45 Attachment part
46 Plastic cover
47 Deflection lever
48 Shaft
49, 49', 49" Conductor pieces
50 Restraint spring
51 Control cam body
52 Control cam
53 Second arm of the striking lever

What is claimed is:

1. An electrical installation switching device comprising:

a housing;

a current path which runs in the housing between a first connecting terminal and a second connecting terminal;

at least one contact point including a stationary contact piece and a moving contact piece, the at least one contact point being configured to at least one of open and close the current path;

a contact lever through which at least part of the current in the current path flows and which is provided with the moving contact piece of the at least one contact point;

an electromagnetic short-circuit current release including a magnetic circuit with an air gap;

an overcurrent release including a switching mechanism operating element which is configured to change from a rest position to a trip position in the event of overcurrent tripping; and a switching mechanism including a striking lever which is configured to be pivoted between a rest position and a trip position, wherein the contact lever is arranged at least partially in the air gap in the magnetic circuit to cause, in the event of a short circuit, an electrodynamic force effect based on an interaction between flow of the current and a magnetic flux within the air gap, the electrodynamic force effect causing rapid opening of the at least one contact point, on the contact lever, wherein the switching mechanism is configured to act, via a first operating connecting line, on the contact lever to at least one of open the at least one contact point and keep the at least one contact point open, wherein, in the event of overcurrent tripping, the overcurrent release is configured to act, by means of the switching mechanism and via a second operating connecting line, on the switching mechanism to open the at least one contact point and keep the at least one contact point open, wherein, in the event of short-circuit tripping, the contact lever is configured to act, via a third operating connecting line, on the switching mechanism to keep the at least one contact point open, and wherein the contact lever is in the form of a moving contact link having two moving contact pieces which are configured to interact with two stationary contact pieces to form two contact points.

2. An electrical installation switching device comprising:

a housing;

a current path which runs in the housing between a first connecting terminal and a second connecting terminal;

at least one contact point including a stationary contact piece and a moving contact piece, the at least one contact point being configured to at least one of open and close the current path;

a contact lever through which at least part of the current in the current path flows and which is provided with the moving contact piece of the at least one contact point;

an electromagnetic short-circuit current release including a magnetic circuit with an air gap;

an overcurrent release including a switching mechanism operating element which is configured to change from a rest position to a trip position in the event of overcurrent tripping; and a switching mechanism including a striking lever which is configured to be pivoted between a rest position and a trip position, wherein the contact lever is arranged at least partially in the air gap in the magnetic circuit to cause, in the event of a short circuit, an electrodynamic force effect based on an interaction between flow of the current and a magnetic flux within the air gap, the electrodynamic force effect causing rapid opening of the at least one contact point, on the contact lever, wherein the switching mechanism is configured to act, via a first operating connecting line, on the contact lever to at least one of open the at least one contact point and keep the at least one contact point open, wherein, in the event of overcurrent tripping, the overcurrent release is configured to act, by means of the switching mechanism and via a second operating connecting line, on the switching mechanism to open the at least one contact point and keep the at least one contact point open, wherein, in the event of short-circuit tripping, the contact lever is configured to act, via a third operating connecting line, on the switching mechanism to keep the at least one contact point open, wherein the switching mechanism operating element includes at its free end a control cam body which has a control cam, and wherein the striking lever is supported on the control cam when the switching mechanism operating element moves to the trip position, to pivot the striking lever to an unlatching position.

3. The electrical installation switching device according to claim 2, wherein the switching mechanism operating element comprises a shaft which is mounted to be rotatable about its longitudinal axis.

4. The electrical installation switching device according to claim 3, wherein the control cam is in the form of a ramp having a first cam section and a second cam section, wherein a ramp gradient of the first cam section is flatter than a ramp gradient of the second cam section.

5. The electrical installation switching device according to claim 1, wherein the short-circuit current release and the overcurrent release are arranged one behind the other in the housing in a flow direction of the current through the current path.

6. The electrical installation switching device according to claim 5, wherein the housing has a front face and includes on the front face an operating lever for manual operation of the switching mechanism, and wherein the switching mechanism is arranged in the housing, between the short-circuit current release and the front face.

7. The electrical installation switching device according to claim 6, wherein the housing has an attachment face which is opposite the front face and which includes attachment means for latching the housing onto a mounting rail.

8. An electrical installation switching device comprising:

a housing;

a current path which runs in the housing between a first connecting terminal and a second connecting terminal;

at least one contact point including a stationary contact piece and a moving contact piece, the at least one contact point being configured to at least one of open and close the current path;

a contact lever through which at least part of the current in the current path flows and which is provided with the moving contact piece of the at least one contact point;

an electromagnetic short-circuit current release including a magnetic circuit with an air gap;

an overcurrent release including a switching mechanism operating element which is configured to change from a rest position to a trip position in the event of overcurrent tripping; and a switching mechanism including a striking lever which is configured to be pivoted between a rest position and a trip position, wherein the contact lever is arranged at least partially in the air gap in the magnetic circuit to cause, in the event of a short circuit, an electrodynamic force effect based on an interaction between flow of the current and a magnetic flux within the air gap, the electrodynamic force effect causing rapid opening of the at least one contact point, on the contact lever, wherein the switching mechanism is configured to act, via a first operating connecting line, on the contact lever to at least one of open the at least one contact point and keep the at least one contact point open, wherein, in the event of overcurrent tripping, the overcurrent release is configured to act, by means of the switching mechanism and via a second operating connecting line, on the switching mechanism to open the at least one contact point and keep the at least one contact point open, wherein, in the event of short-circuit tripping, the contact lever is configured to act, via a third operating connecting line, on the switching mechanism to keep the at least one contact point open wherein the switching mechanism operating element of the overcurrent release is coupled to an overcurrent magnetic circuit, wherein a force which acts on the switching mechanism operating element is produced by the magnetic field of the overcurrent, wherein the switching mechanism operating element is coupled to an electromagnetic damping element to set the tripping delay time, and wherein the switching mechanism operating element is coupled to an adjusting element to adjust a tripping threshold of the overcurrent.

9. The electrical installation switching device according to claim 1, wherein the contact lever is coupled to the striking lever via a deflection lever.

10. The electrical installation switching device according to claim 3, wherein the switching mechanism operating element of the overcurrent release is coupled to an overcurrent magnetic circuit, wherein a force which acts on the switching mechanism operating element is produced by the magnetic field of the overcurrent, wherein the switching mechanism operating element is coupled to an electromagnetic damping element to set the tripping delay time, and wherein the switching mechanism operating element is coupled to an adjusting element to adjust a tripping threshold of the overcurrent.

11. The electrical installation switching device according to claim 7, wherein the switching mechanism operating element of the overcurrent release is coupled to an overcurrent magnetic circuit, wherein a force which acts on the switching mechanism operating element is produced by the magnetic field of the overcurrent, wherein the switching mechanism operating element is coupled to an electromagnetic damping element to set the tripping delay time, and wherein the switching mechanism operating element is coupled to an adjusting element to adjust a tripping threshold of the overcurrent.

12. The electrical installation switching device according to claim 8, wherein the contact lever is in the form of a moving contact link having two moving contact pieces which are configured to interact with two stationary contact pieces to form two contact points.

13. The electrical installation switching device according to claim 11, wherein the contact lever is coupled to the striking lever via a deflection lever.

* * * * *